US011337870B2

(12) United States Patent
Thompson et al.

(10) Patent No.: US 11,337,870 B2
(45) Date of Patent: May 24, 2022

(54) EMERGENCY STRETCHER WITH TRACK DRIVE

(71) Applicants: Bradley Michael Thompson, Arnprior (CA); Rodney Eugene Thompson, Pakenham (CA); Jason Christopher Watt, Pakenham (CA); James Robert Dodge, Arnprior (CA); Julian Jan Oscroft, Carp (CA)

(72) Inventors: Bradley Michael Thompson, Arnprior (CA); Rodney Eugene Thompson, Pakenham (CA); Jason Christopher Watt, Pakenham (CA); James Robert Dodge, Arnprior (CA); Julian Jan Oscroft, Carp (CA)

( * ) Notice: Subject to any disclaimer, the term of this patent is extended or adjusted under 35 U.S.C. 154(b) by 99 days.

(21) Appl. No.: 16/829,287

(22) Filed: Mar. 25, 2020

(65) Prior Publication Data

US 2020/0306112 A1 Oct. 1, 2020

Related U.S. Application Data

(60) Provisional application No. 62/824,520, filed on Mar. 27, 2019.

(51) Int. Cl.
*A61G 1/04* (2006.01)
*A61G 1/02* (2006.01)

(52) U.S. Cl.
CPC ..... *A61G 1/0281* (2013.01); *A61G 1/0237* (2013.01); *A61G 1/0275* (2013.01); *A61G 1/04* (2013.01); *A61G 2203/10* (2013.01)

(58) Field of Classification Search
CPC .... A61G 1/025; A61G 1/0275; A61G 1/0281; A61G 1/0237; A61G 1/04; A61G 2203/10
See application file for complete search history.

(56) References Cited

U.S. PATENT DOCUMENTS 8,025,325 B1 9/2011 Carrier et al.
2006/0195987 A1 9/2006 Walkingshaw
(Continued)

FOREIGN PATENT DOCUMENTS

CA 2185471 A1 10/1996
CN 203790154 U 8/2014
(Continued)

OTHER PUBLICATIONS

Wikipedia page for Stretcher, https://en.wikipedia.org/wiki/Stretcher, accessed Mar. 19, 2020.
(Continued)

*Primary Examiner* — Fredrick C Conley
(74) *Attorney, Agent, or Firm* — Noblitt & Newson, PLLC

(57) ABSTRACT

A self-propelled emergency stretcher includes an elongate frame having a set of wheels a track drive unit mounted thereto. The set of wheels includes first wheels at a front end of the frame and second wheels at a rear end of the frame, and the track drive unit is mounted between the first wheels and the second wheels. A plurality of actuators is configured to raise and lower the first wheels and the second wheels relative to the frame, so as to selectively switch the emergency stretcher between a self-propelled configuration and a manually-propelled configuration. In the self-propelled configuration the first wheels and the second wheels are out of contact with a ground surface below the emergency stretcher and the track drive unit is in contact with the ground surface. In the manually-propelled configuration the first wheels and the second wheels are in contact with the ground surface and the track drive unit is out of contact with the ground surface.

16 Claims, 5 Drawing Sheets

(56) References Cited

U.S. PATENT DOCUMENTS

| | | | | |
|---|---|---|---|---|
| 2014/0259420 | A1* | 9/2014 | Lambarth | A61G 5/1059 5/618 |
| 2014/0326522 | A1* | 11/2014 | Maurer | A61G 5/06 180/24.02 |

FOREIGN PATENT DOCUMENTS

| | | | |
|---|---|---|---|
| CN | 204121284 | U | 1/2015 |
| CN | 106109110 | A | 11/2016 |
| CN | 206612892 | U | 11/2017 |
| FR | 2883243 | B1 | 9/2006 |
| RU | 2542827 | C1 | 2/2015 |
| SE | 8803877 | | 10/1988 |
| WO | 2004039300 | A1 | 5/2004 |

OTHER PUBLICATIONS

Stryker Stair-PRO Model No. 6252, https://www.stryker.com/US/en/emergency-care/products/stair-pro.html, accessed Mar. 19, 2020.

* cited by examiner

EMERGENCY STRETCHER WITH TRACK DRIVE

CROSS-REFERENCES TO RELATED APPLICATIONS

This application claims the benefit of U.S. Provisional Patent Application No. 62/824,520, filed Mar. 27, 2019, and incorporates the disclosure of the application by reference.

FIELD OF THE INVENTION

The present disclosure relates generally to an emergency stretcher of the type that is used to transport patients in an ambulance or within a hospital. More particularly, the present disclosure relates to an emergency stretcher with a track drive that is suitable for operating the stretcher in a self-propelled mode and over uneven or loosely packed surfaces.

BACKGROUND

Emergency stretchers are known for transporting patients in an ambulance and for transporting patients within a hospital. A typical emergency stretcher includes a patient litter or cot that is supported on an X-frame undercarriage equipped with wheels. The X-frame allows the patient litter to be raised and lowered to facilitate loading of a patient onto the litter, loading the stretcher into an ambulance and subsequently unloading the stretcher from the ambulance, etc. Although the prior art emergency stretchers are generally adequate for their intended purposes, they are not satisfactory in all regards.

Known emergency stretchers are constructed to move on a set of wheels, which are suitable for use on smooth surfaces including hospital floors, concrete pathways, paved driveways, etc. As will be apparent, the wheels are not well suited for use on uneven or loosely packed surfaces including gravel driveways, deep snow, sand, cobblestone walkways, grass, fields, wooded areas etc. When operated on uneven or loosely packed surfaces the wheels of a prior art emergency stretcher may become obstructed, entangled or buried, making it difficult or even impossible for emergency medical service (EMS) providers to transport a patient in the normal fashion. Under such conditions it may be necessary to use a specialized patient transport vehicle, such as for instance an all-terrain vehicle equipped with a patient litter. Alternatively, it may be necessary for the EMS providers to lift the stretcher, including the patient and any medical equipment associated therewith, over the uneven or loosely packed surface.

Of course, a specialized transport vehicle may not be readily available and therefore valuable time may be wasted waiting for such a vehicle to arrive. On the other hand, lifting the stretcher including the patient and medical equipment, over even a short distance, unacceptably increases the risk of an injury occurring to the EMS providers and/or volunteers assisting with the patient transport.

In fact, the problem of injuries occurring to EMS providers during patient transport is a serious and long-standing one. According to a study that was published in December 2007 (Studnek et al., "On the job illness and injury resulting in lost work time among a national cohort of emergency medical services professionals," *American Journal of Industrial Medicine*, Vol. 50, Issue 12, pp. 921-931) almost 10% of all emergency medical technicians and paramedics in the United States at any given time were missing work because of a job-related injury or illness, which increases to almost 19% in busy systems that handle more than 40 calls per week. The most common types of injuries, accounting for nearly 30% of all workplace injuries and illness occurring in EMS providers, are body motion injuries including back and neck sprains and strains caused by excessive physical effort, awkward posture or repetitive movement. Slips, trips and falls account for another 15% of workplace injuries and illness in EMS providers, wherein 40% of such incidents involved the EMS provider going up or down a step or curb.

The high level of workplace injuries in EMS providers may be attributed to performing repetitive movements while lifting or moving a heavy load. For instance, a prior art stretcher weighs approximately 120 pounds when empty, but the total weight may exceed 350 pounds when loaded with a patient and medical equipment. In the case of bariatric patient transfer the total weight that is being transported exceeds 350 pounds by a considerable amount. Other factors that contribute to the occurrence of workplace injuries include shifting of the patient's balance or position while being transported, which requires the EMS provider to compensate, or manoeuvring through narrow passages, which requires the EMS provider to bend or twist.

Another problem associated with prior art emergency stretchers is that two EMS providers are required to transport a patient safely—one EMS provider guiding the foot-end of the stretcher and the other EMS provider guiding the head-end of the stretcher. As a result, neither EMS provider is available to retrieve equipment from the ambulance or to attend to another patient, etc.

Further, the prior art emergency stretcher is typically moved with the patient litter in the raised position. Although this configuration allows the EMS providers to move the patient without being required to bend down to reach the patient litter, it also has the unfortunate effect of raising the centre of mass, which increases the likelihood that the emergency stretcher will tip over. Tipping of the emergency stretcher is undesirable because the patient being transported may be thrown to the ground, causing bodily harm to the patient, and/or the EMS providers may suffer an injury while attempting to compensate for the tipping motion.

It would therefore be beneficial to provide methods and apparatus that overcome at least some of the above-mentioned disadvantages and/or limitations that are associated with prior art emergency stretchers.

SUMMARY OF THE INVENTION

In accordance with an aspect of at least one embodiment there is provided a self-propelled emergency stretcher, comprising: a patient litter having a head-end and a foot-end; a frame disposed below the patient litter; a track drive unit mounted to the frame, the track drive unit comprising a left-side track and a right-side track; a head-end caster wheel assembly mounted to a first end of the frame via a head-end caster wheel assembly lift actuator; a foot-end caster wheel assembly mounted to a second end of the frame via a foot-end caster wheel assembly lift actuator, the second end being opposite the first end; and a controller for selectively switching the head-end caster wheel assembly lift actuator and the foot-end caster wheel assembly lift actuator between: a first configuration in which the head-end caster wheel assembly and the foot-end caster wheel assembly are out of contact with a ground surface below the emergency stretcher and the left-side track and the right-side track are in contact with the ground surface; and a second configuration in which the head-end caster wheel assembly and the foot-end caster wheel assembly are in contact with the ground surface and the left-side track and the right-side track are out of contact with the ground surface.

In accordance with an aspect of at least one embodiment there is provided a self-propelled emergency stretcher, comprising: an elongate frame; a set of wheels including first wheels disposed at a front end of the frame and second wheels disposed at a rear end of the frame; a track drive unit mounted to the frame between the first wheels and the second wheels; and a plurality of actuators for raising and lowering the first wheels and the second wheels relative to the frame; wherein the plurality of actuators is configured to selectively switch the emergency stretcher between a self-propelled configuration in which the first wheels and the second wheels are out of contact with a ground surface below the emergency stretcher and the track drive unit is in contact with the ground surface and a manually-propelled configuration in which the first wheels and the second wheels are in contact with the ground surface and the track drive unit is out of contact with the ground surface.

In accordance with an aspect of at least one embodiment there is provided a method for transporting a patient using a self-propelled emergency stretcher having a pair of tracks and a set of wheels, the method comprising: transporting the patient over a first terrain in a self-propelled mode of operation in which the tracks engage a ground surface of the first terrain and are powered by an on-board power plant of the emergency stretcher; lowering the set of wheels into contact with the ground surface and concomitantly raising the pair of tracks out of contact with the ground surface; and transporting the patient over a second terrain in a manually propelled mode of operation in which the set of wheels engage a ground surface of the second terrain.

BRIEF DESCRIPTION OF THE DRAWINGS

The instant invention will now be described by way of example only, and with reference to the attached drawings, wherein similar reference numerals denote similar elements throughout the several views, and in which.

DETAILED DESCRIPTION OF EMBODIMENTS OF THE INVENTION

The following description is presented to enable a person skilled in the art to make and use the invention and is provided in the context of a particular application and its requirements. Various modifications to the disclosed embodiments will be readily apparent to those skilled in the art, and the general principles defined herein may be applied to other embodiments and applications without departing from the scope of the invention. Thus, the present invention is not intended to be limited to the embodiments disclosed but is to be accorded the widest scope consistent with the principles and features disclosed herein.

Throughout the description and in the appended claims the terms "left" and "right" are understood to be with respect to an operator positioned at the foot end of the emergency stretcher and facing toward the emergency stretcher. The term "front" refers to the head end of the emergency stretcher and the term "rear" refers to the foot end of the emergency stretcher.

Figure 1:
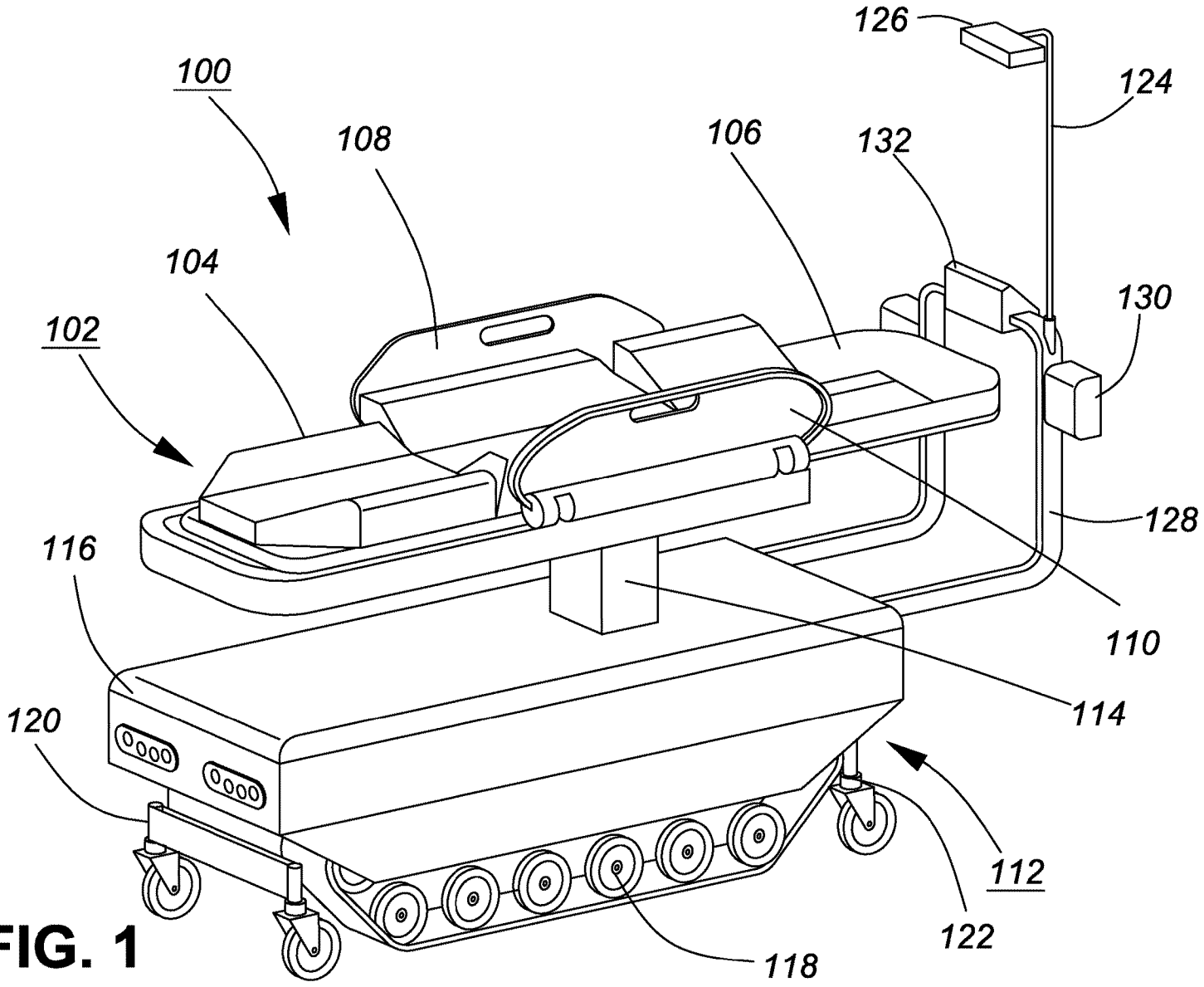
FIG. 1 is a simplified perspective view of an emergency stretcher with a track drive according to an embodiment.

Referring to FIG. 1, shown is a simplified perspective view of a self-propelled patient transport apparatus, in the form of an emergency stretcher 100, according to an embodiment. The emergency stretcher 100 includes a patient litter 102, equivalently referred to as a bed or cot, upon which the patient is placed for transport. The patient litter 102 has a head end 104 and a foot end 106. Alternatively, the patient litter 102 may have an opposite configuration such that 104 is the foot end and 106 is the head end. Side panels 108 and 110 extend one each along opposite sides of the patient litter, at least part of the way between the head end 104 and the foot end 106. The side panels 108 and 110 may be moved between a raised position (shown in FIG. 1) and a lowered position (not illustrated) in a known manner. The patient litter 102 is supported on a body 112 and can be raised and lowered relative to the body 112 using an actuator 114, such as for instance one or more lift cylinder. The actuator 114 may be pneumatically or hydraulically powered or it may employ gears, screws and or chains of various designs for lifting and lowering of the patient litter 102 relative to the body 112. For instance, the actuator 114 may be used to raise and lower the patient litter 102 for transferring a patient to a hospital cot, bed or table, and to adjust the height of the patient litter 102 for patient transfers to suit the height of the EMS providers.

The body 112 includes a cover 116 to prevent clothing, cords, body parts etc. from becoming entangled in the various mechanisms that are disposed therebelow. The cover 116 also protects the various mechanisms from exposure to bodily fluids and/or rain/snow etc. and is fabricated from a material that is easily cleaned after use. The body 112 contains a main power plant (not illustrated in FIG. 1). In an embodiment the power plant includes at least one or more electric motor, one or battery, and a hydraulic power unit. Alternatively, the power plant may include a gasoline-powered or diesel-powered motor and an associated fuel reservoir. The power plant powers a track drive unit 118 for operating the emergency stretcher 100 in a self-propelled mode and over uneven surfaces, and additionally powers castor wheel lift actuators (not illustrated in FIG. 1) for raising and lowering sets of castor wheels 120 and 122 relative to the track drive unit 118 and track widening actuators (not illustrated in FIG. 1) for widening and narrowing the space between the tracks of the track drive unit 118. The castor wheel lift actuators and the track widening actuators may be any commonly known type of actuator, including but not limited to hydraulic actuators, pneumatic actuators, belt-driven actuators, screw-driven actuators, rack and pinion driven actuator, linear motor driven actuators, etc. Alternatively, the castor wheel lift actuators may be manually operated mechanisms that require the operator to press down on a foot pedal or turn a hand crank etc. to raise and lower the sets of castor wheels 120 and 122 relative to the track drive unit 118. Of course, the sets of castor wheels 120 and/or 122 include standard safety features such as for instance parking brake and service brake mechanisms, which may be the same or different mechanisms. Additionally, the tracks of the track drive unit 118 also include standard safety features such as for instance parking brake and service brake mechanisms, which may be the same or different mechanisms.

The emergency stretcher in the embodiment that is shown in FIG. 1 further includes additional elements that may find use during patient transfer and care. For instance, a support pole 124 is provided for supporting e.g., intravenous drip bags. A lighting unit 126, such as for instance an LED lighting unit, may be disposed on the support pole 124 or at another suitable attachment point on the emergency stretcher. The lighting unit 126 may be powered by the main power plant of the emergency stretcher or by a separate battery pack. In this specific example the lighting unit 126 is illustrated as a single module, which may provide one or more of scene lighting, driving lighting and emergency lighting. Optionally, the lighting unit 126 includes plural lighting units, each of which provides only one of scene lighting, driving lighting or emergency lighting. A control frame 128 may be provided at one end of the emergency stretcher 102, which may serve as a handle for pushing or pulling the emergency stretcher and may provide rollover protection for the patient. Various electronic modules may be mounted to the control frame 128, such as for instance an operator control unit 130 for controlling the emergency stretcher in a self-propelled mode and a patient monitoring system 132 for providing patient monitoring system readout and communications functionality. For instance, the patient monitoring system 132 may support on board two-way digital video communications with hospital and trauma doctors.

Additional actuators and mechanisms may be provided for inclining the patient litter 102, either in whole or in part. For instance, the head end 104 of the patient litter 102 may be pivotally coupled to the foot end 106 such that the head end 104 may be inclined to allow the patient to assume a semi-sitting position. The control frame 128 including operator control unit 130 may index when the head end 104 raises so as to reduce the length of the emergency stretcher 100 and thereby improve maneuverability in small or tight spaces. Alternatively, the foot end 106 may be inclined to place the patient in "shock position." Optionally, the patient litter 102 may be inclined as a whole, along either the front-to-back or left-to-right direction, or both. Optionally, the attitude of the patient litter is adjusted in real-time as the emergency stretcher moves over hilly or uneven terrain so as to maintain the patient in an approximately horizontal position.

Of course, restraint straps or other devices for securing the patient to the patient litter 102 may be provided in the known fashion. Optionally, a not illustrated shroud or cover may be secured over the patient litter 102 to partially or substantially fully cover the patient during transport. The shroud or cover protects the patient and medical equipment from weather conditions such as rain, snow wind etc. Further, the shroud or cover protects the patient, medical equipment, cords and tubing from branches etc. during backcountry and other wilderness evacuations. Further still, the interior of the shroud is climate controlled to protect the patient and/or medical equipment in cold and hot conditions, and/or for beginning medical treatment such as for instance during the rescue of a hypothermia victim.

Figure 2A:
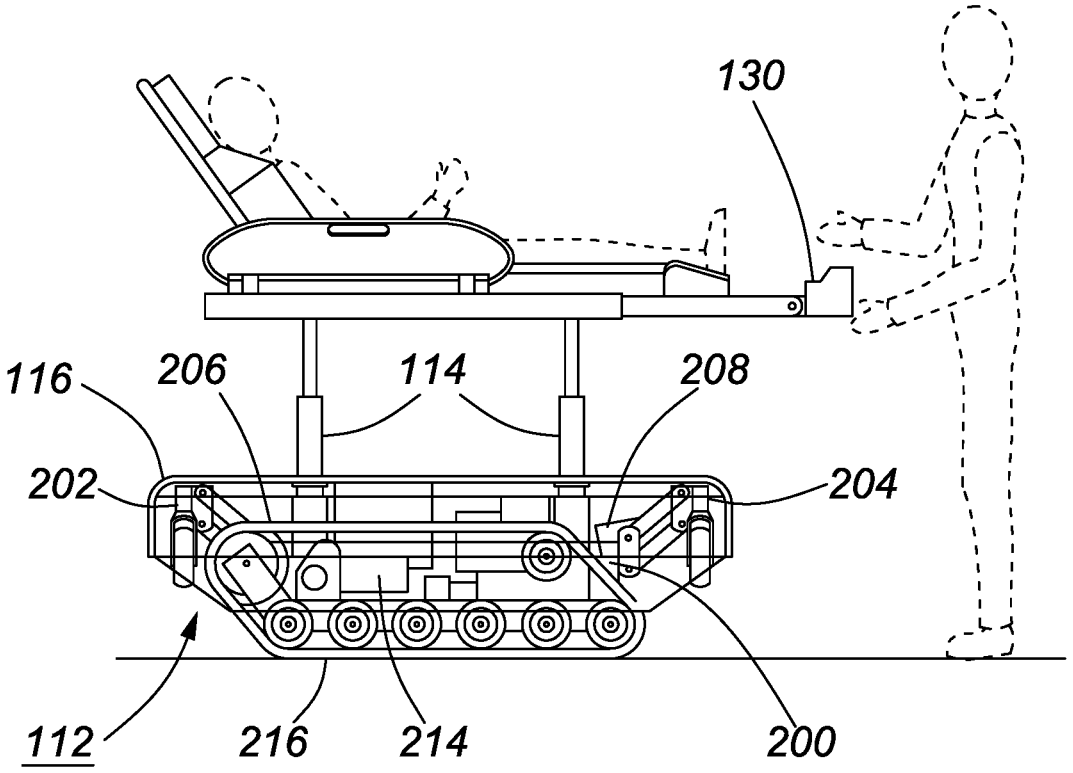
FIG. 2*a* is a side view showing an emergency stretcher with tracks engaging a ground surface and wheels in a retracted position according to an embodiment.
Figure 3:
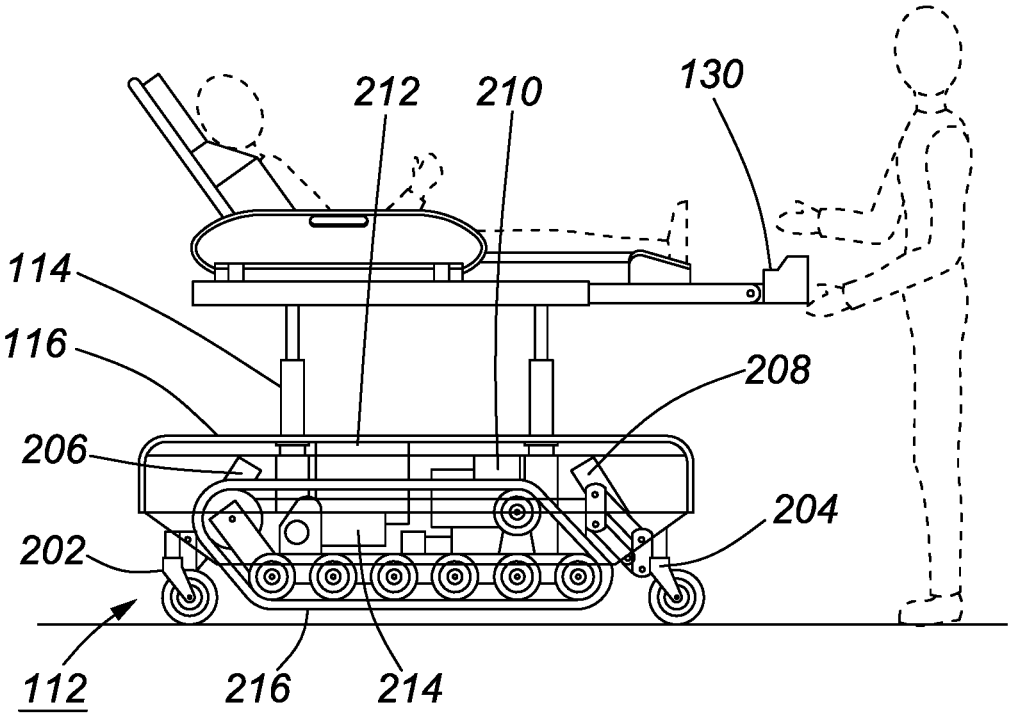
FIG. 3 is a side view showing the emergency stretcher of FIG. 2*a* with wheels in an extended and ground engaging position and tracks out of contact with a ground surface.

FIG. 2*a* is a side view showing an emergency stretcher in a self-propelled track-drive mode according to an embodiment. FIG. 3 is a side view of the emergency stretcher in a manually-propelled wheeled mode. The cover 116 is shown as semi-transparent in FIGS. 2*a* and 3 in order to reveal the support frame 200 and the various mechanisms that are mounted thereto. In particular, head end castor wheel assembly 202 and foot end castor wheel assembly 204 are mounted to the support frame 200 via head end castor wheel assembly lift actuator 206 and foot end castor wheel assembly lift actuator 208, respectively. Also mounted to the frame 200 are hydraulic power unit 210 and battery 212. The battery is for instance a lithium ion battery or a lead acid battery.

Figure 2B:
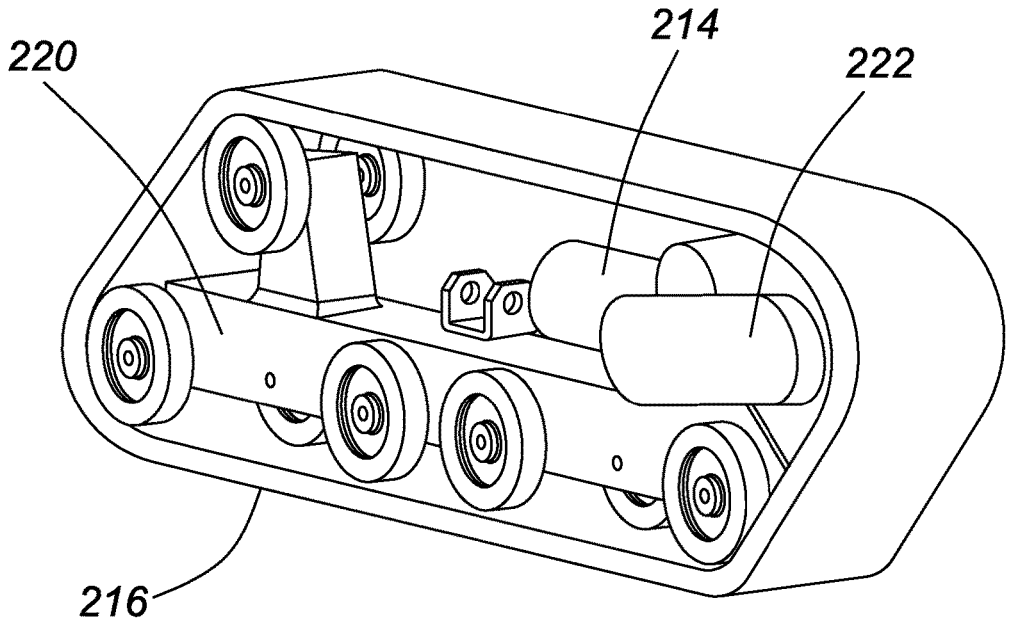
FIG. 2*b* is a perspective view showing the left undercarriage assembly of the emergency stretcher of FIG. 2*a*.
Figure 2C:
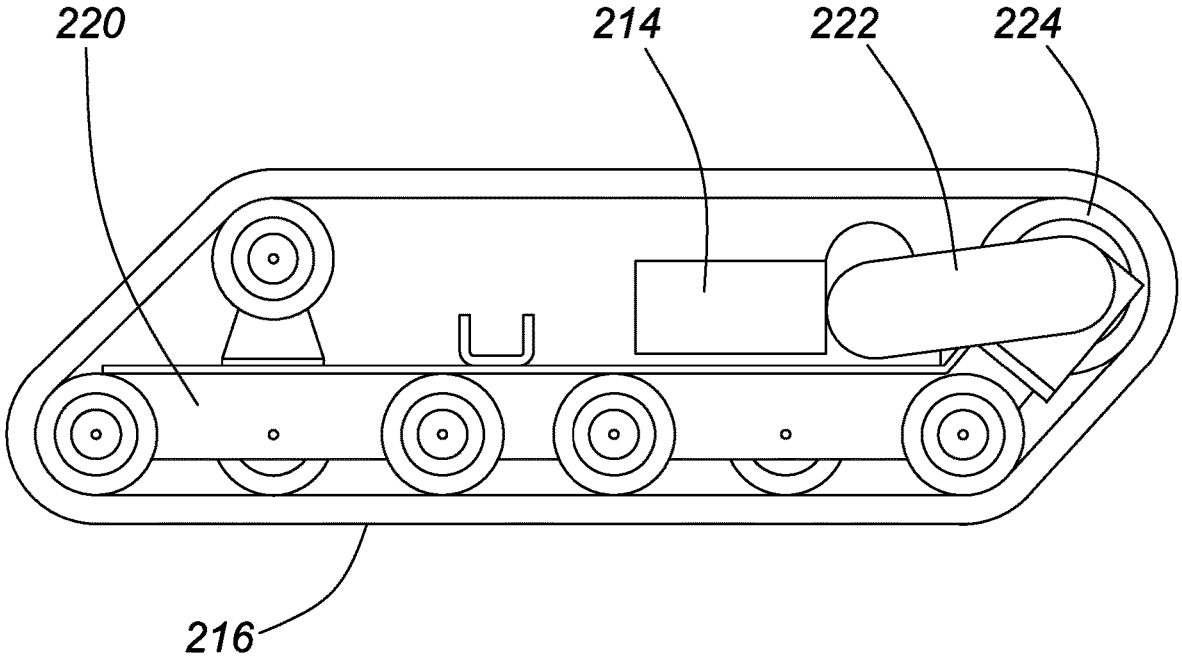
FIG. 2*c* is a side view showing the left undercarriage assembly of the emergency stretcher of FIG. 2*a*.

Now referring also to FIGS. 2*b* and 2*c*, a left-side electric drive motor 214 is mounted on a left-side undercarriage frame 220 opposite a not illustrated right-side electric drive motor mounted on a not illustrated right-side undercarriage frame. During use, left-side electric drive motor 214 powers left-side track 216 of track drive unit 118 via a left-side power transfer unit 122 coupled to a left-side track-drive sprocket 124. Similarly, the not illustrated right-side electric drive motor powers the not illustrated right-side track of track drive unit 118 via a not illustrated right-side power transfer unit coupled to a not illustrated right-side track-drive sprocket. The left-side track and the right-side track are powered independently in order to improve maneuverability of the emergency stretcher, such as for instance by enabling the tracks to counter rotate for maneuvering in tight areas.

Figure 2D:
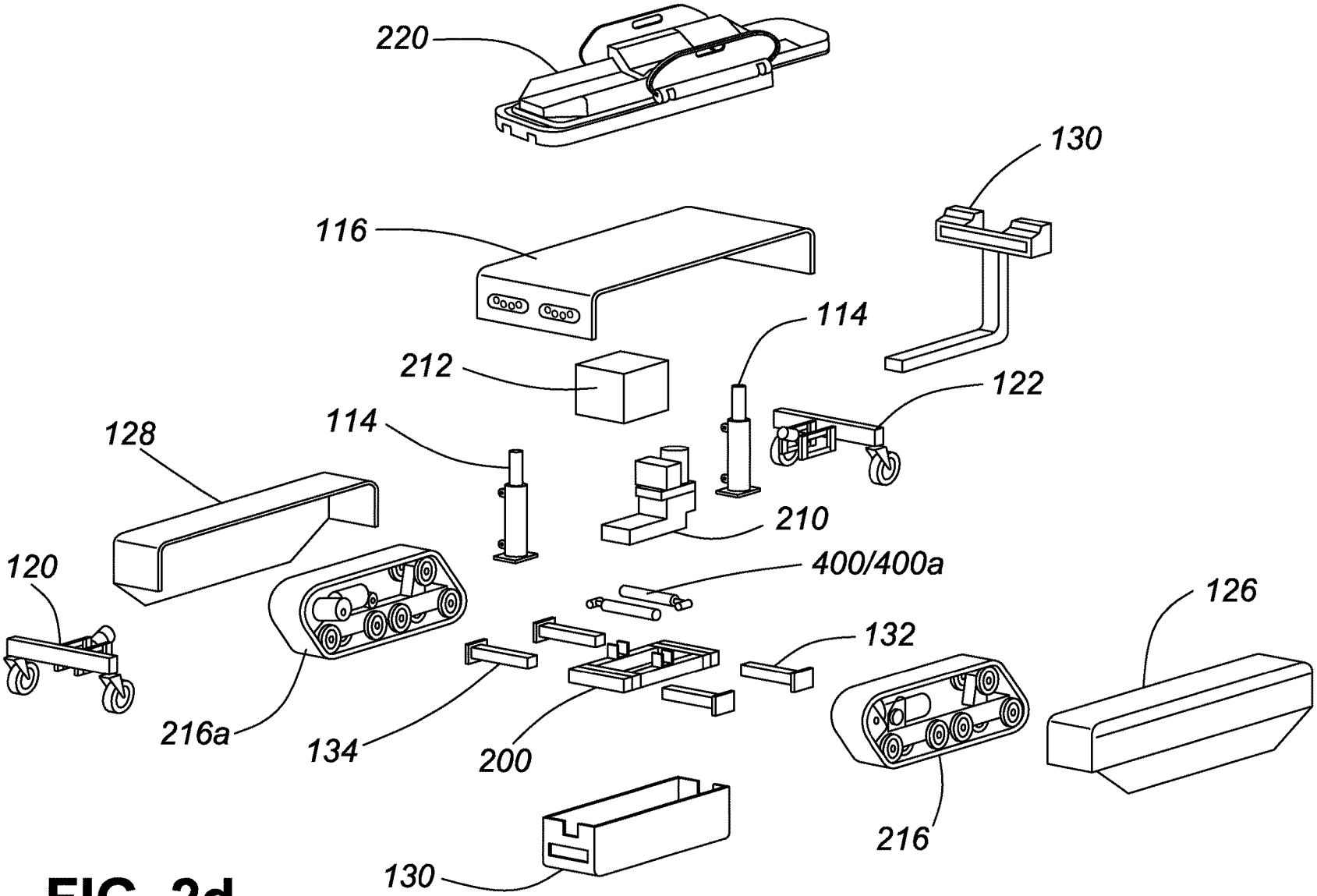
FIG. 2*d* is an exploded view showing an emergency stretcher according to an embodiment.

FIG. 2*d* is an exploded view of the emergency stretcher, which shows more clearly all of the parts that have been discussed above. FIG. 2*d* also shows additional safety covers, including left track drive unit body panel 126, right track drive unit body panel 128 and bottom body panel 130. Also shown in FIG. 2*d* are left side telescoping frame 132 and right-side telescoping frame 134, which connect the left side track 216 and the right-side track 216*a* of track drive unit 118 to the support frame 200.

Figure 6:
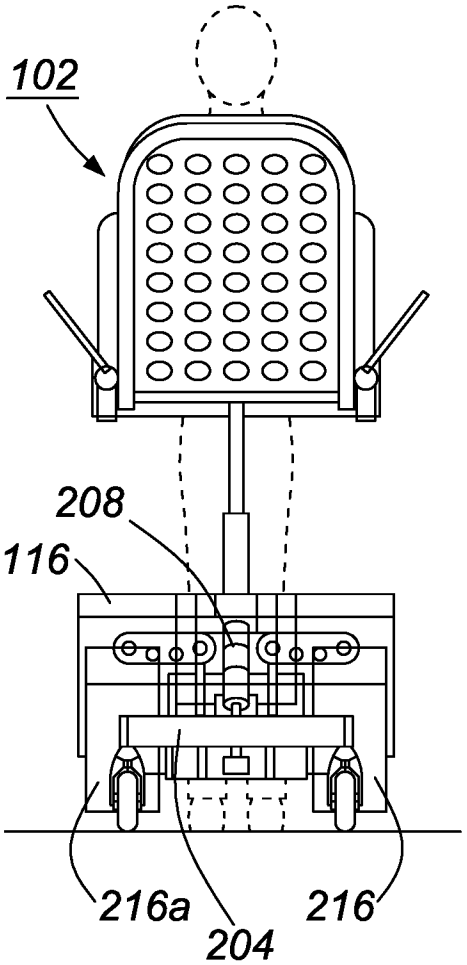
FIG. 6 is a front view showing the emergency stretcher of FIGS. 2*a* and 3 with tracks out of contact with a ground surface and in a laterally retracted position.
Figure 5:
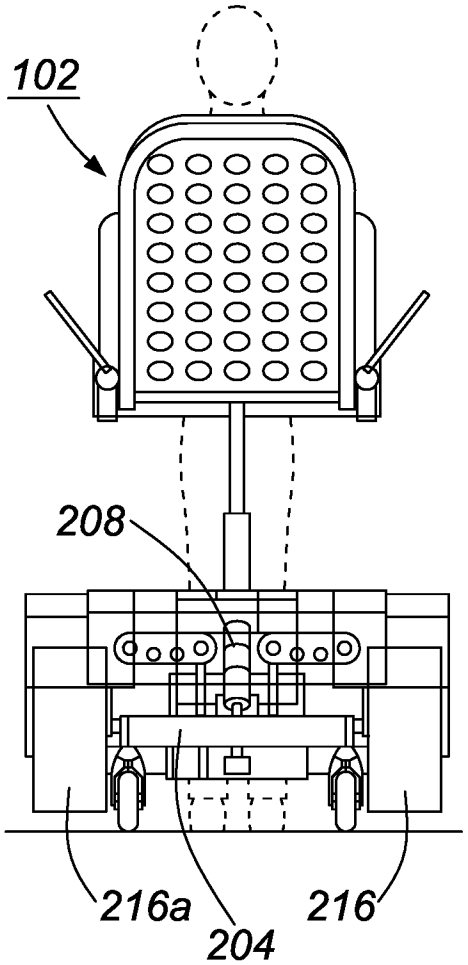
FIG. 5 is a front view showing the emergency stretcher of FIGS. 2*a* and 3 with tracks out of contact with a ground surface and in a laterally extended position.
Figure 4:
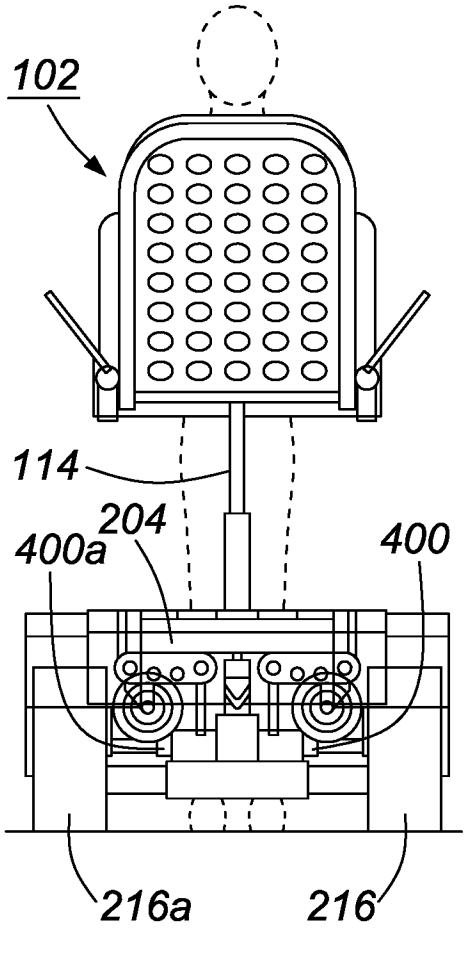
FIG. 4 is a front view showing the emergency stretcher of FIGS. 2*a* and 3 with tracks engaging a ground surface and in a laterally extended position.

FIGS. 4-6 are front views showing the emergency stretcher of FIGS. 2*a* and 3 in different operating modes and/or configurations.

FIG. 4 shows the emergency stretcher configured with the left-side track 216 and the right-side track 216*a* of track drive unit 118 in contact with a ground surface. In this configuration, the head end castor wheel assembly lift actuator 206 raises the head end castor wheel assembly 202 out of ground contact and the foot end castor wheel assembly lift actuator 208 raises the foot end castor wheel assembly 204 out of ground contact. A left-side track widening actuator 400 and a right-side track widening actuator 400*a* extend the left-side track 216 and the right-side track 216*a*, respectively, outwardly away from one another into a so-called "widened stance." Spacing apart the tracks in the manner that is shown in FIG. 4 increases the stability of the emergency stretcher, especially when operating the emergency stretcher over hilly or sloped terrain. Stability may be further improved by moving the patient litter 102 into its lowered position using the actuator 114 and/or lowering the head end of the patient litter 102 so the patient lies flat.

Referring now to FIG. 5, the emergency stretcher is shown in a configuration with the castor wheel assemblies 202 and 204 in contact with a ground surface. In this configuration, the head end castor wheel assembly lift actuator 206 lowers the head end castor wheel assembly 202 and foot end castor wheel assembly lift actuator 208 lowers the foot end castor wheel assembly 204. The actuators 206 and 208 continue to operate after the castor wheel assemblies 202 and 204 contact the ground surface, thereby lifting the left-side and right-side tracks 216 and 216*a* out of contact with the ground surface. Further, as is shown in FIG. 5 the left-side and right-side tracks 216 and 216*a* are in a "widened stance." Spacing apart the tracks in the manner that is shown in FIG. 4 increases the stability of the emergency stretcher, especially when operating the emergency stretcher over hilly or sloped terrain. Servicing of the track drive unit 118 may be performed more easily when the emergency stretcher is configured in the way that is shown in FIG. 5.

FIG. 6 shows the emergency stretcher configured with the castor wheel assemblies 202 and 204 in contact with a ground surface. Similar to the configuration that is shown in FIG. 5, the head end castor wheel assembly lift actuator 206 lowers the head end castor wheel assembly 202 and foot end castor wheel assembly lift actuator 208 lowers the foot end castor wheel assembly 204. The actuators 206 and 208 continue to operate after the castor wheel assemblies 202 and 204 contact the ground surface, thereby lifting the left-side and right-side tracks 216 and 216*a* out of contact with the ground surface. Unlike the configuration that is shown in FIG. 5, the left-side and right-side tracks 216 and 216*a* are shown in a "narrowed stance" in FIG. 6.

The emergency stretcher 100 may be used in the same way that prior art emergency stretchers are used for transporting patients over even and solid or hard-packed surfaces. In particular, the stretcher is configured as shown in either FIG. 5 or FIG. 6, depending upon whether it is desirable to have the tracks 216 and 216*a* extended into the "widened stance" or retracted into the "narrowed stance." The EMS providers manually push or pull the emergency stretcher 100, which simply rolls on the castor wheel assemblies 202 and 204.

When it becomes necessary or desirable to operate the stretcher 100 in its self-propelled track-drive mode, then the stretcher is adjusted to the configuration that is shown in FIG. 4. In particular, if the tracks 216 and 216*a* are currently in the "narrowed stance" then one of the first adjustments is to extend the tracks 216 and 216*a* into the widened stance using the track widening actuators 400 and 400*a*. This adjustment should be made before the tracks 216 and 216*a* are lowered into contact with the ground surface. The castor wheel assembly lift actuators 206 and 208 are then used to raise the head end and foot end castor wheel assemblies 202 and 204, respectively, out of contact with the ground surface. The actuators 206 and 208 continue to operate until the castor wheel assemblies 202 and 204 are fully retracted into the body 112.

The operator control unit 130 may be used by the EMS provider to control the emergency stretcher in the self-propelled mode. For instance, the EMS provider may cause the left and right tracks 216 and 216*a* to rotate in the same direction forward or reverse, or to counter-rotate so as to turn the emergency stretcher or even spin the emergency stretcher on the spot. The tracks 216 and 216*a* are capable of driving the emergency stretcher over terrain that includes rocks, sticks, ditches, inclines, stairs, curbs, sand, snow, mud, gravel, grass etc. When transporting a patient across the types of non-standard terrains that are mentioned above it is advisable for two EMS providers to accompany the emergency stretcher even when it is being operated in the self-propelled mode. On the other hand, when transporting a patient across a level terrain or within a hospital or other building it may be necessary for only one EMS provider to accompany the emergency stretcher. Thus, a second EMS provider becomes available to retrieve equipment from the ambulance or assist other patients, etc.

Optionally, the EMS provider uses a remote-control unit, in particular a wireless remote control unit, to control the emergency stretcher 100 from a safe distance. For instance, the EMS provider may remotely pilot the emergency stretcher to a patient that is injured but still capable of climbing onto the fully lowered patient litter 102. Once the patient has climbed onto the patient litter and preferably secured a patient restraint, the EMS provider may remotely pilot the emergency stretcher along a return path. Once the emergency stretcher has returned the EMS provider may evaluate the patient and provide care, ensure that the patient is properly secured, etc. The remote-control self-propelled mode is useful if the patient is in a hazardous area, such as for instance an area with biological, chemical, or nuclear contamination or even under combat conditions for military applications. Although remote-control operation of the emergency stretcher is not preferred it can nevertheless be used to retrieve a patient without putting an EMS provider at risk, and without wasting valuable time waiting for specialized protective equipment to arrive and/or donning such protective equipment before entering the hazardous area.

Once the emergency stretcher moves back onto a hard-packed or even surface it may be desired to once again operate the emergency stretcher 100 in the manner of a prior art emergency stretcher. The castor wheel assembly lift actuators 206 and 208 are used to lower the head end and foot end castor wheel assemblies 202 and 204, respectively, into contact with the ground surface. The actuators 206 and 208 continue to operate until the track drive unit 118 is raised a predetermined height above the ground. Optionally, the track widening actuators 400 and 400*a* are operated to retract the tracks 216 and 216*a* into the narrowed stance depending on whether or not additional maneuverability is needed in order to move through tight passages etc. The EMS providers may the push or pull the emergency stretcher 100 in a manually propelled fashion, for instance to transfer the patient through hospital hallways, etc.

In the description of the invention herein, it is understood that a word appearing in the singular encompasses its plural counterpart, and a word appearing in the plural encompasses its singular counterpart, unless implicitly or explicitly understood or stated otherwise. For instance, unless the context indicates otherwise, a singular reference, such as "a" or "an" means "one or more". Furthermore, it is understood that for any given component or embodiment described herein, any of the possible candidates or alternatives listed for that component may generally be used individually or in combination with one another, unless implicitly or explicitly understood or stated otherwise. Additionally, it will be understood that any list of such candidates or alternatives is merely illustrative, not limiting, unless implicitly or explicitly understood or stated otherwise. It is also to be understood, where appropriate, like reference numerals may refer to corresponding parts throughout the several views of the drawings for simplicity of understanding.

Throughout the description and claims of this specification, the words "comprise," "including," "having," and "contain" and variations of the words, for example "comprising" and "comprises" etc., mean "including but not limited to," and are not intended to (and do not) exclude other components.

It will be appreciated that variations to the foregoing embodiments of the invention can be made while still falling within the scope of the invention. Each feature disclosed in this specification, unless stated otherwise, may be replaced by alternative features serving the same, equivalent or similar purpose. Thus, unless stated otherwise, each feature disclosed is one example only of a generic series of equivalent or similar features.

The use of any and all examples, or exemplary language ("for instance," "such as," "for example," "e.g.," and like language) provided herein, is intended merely to better illustrate the invention and does not indicate a limitation on the scope of the invention unless otherwise claimed. No language in the specification should be construed as indicating any non-claimed element as essential to the practice of the invention.

Any steps described in this specification may be performed in any order or simultaneously unless stated or the context requires otherwise.

All of the features disclosed in this specification may be combined in any combination, except combinations where at least some of such features and/or steps are mutually exclusive. In particular, the preferred features of the invention are applicable to all aspects of the invention and may be used in any combination. Likewise, features described in non-essential combinations may be used separately (not in combination).

What is claimed is:

1. A self-propelled emergency stretcher, comprising:

a patient litter having a head-end and a foot-end;

a frame disposed below the patient litter;

a track drive unit mounted to the frame, the track drive unit comprising a left-side track and a right-side track;

a power plant mounted to the frame, the power plant configured to power the left-side track and the right-side track independently of one another;

a head-end caster wheel assembly mounted to a first end of the frame via a head-end caster wheel assembly lift actuator;

a foot-end caster wheel assembly mounted to a second end of the frame via a foot-end caster wheel assembly lift actuator, the second end being opposite the first end; and a controller for selectively switching the head-end caster wheel assembly lift actuator and the foot-end caster wheel assembly lift actuator between:

a first configuration in which the head-end caster wheel assembly and the foot-end caster wheel assembly are out of contact with a ground surface below the emergency stretcher and the left-side track and the right-side track are in contact with the ground surface; and a second configuration in which the head-end caster wheel assembly and the foot-end caster wheel assembly are in contact with the ground surface and the left-side track and the right-side track are out of contact with the ground surface.

2. The self-propelled emergency stretcher of claim 1, comprising a left-side track widening actuator disposed between the left-side track and the frame and a right-side track widening actuator disposed between the right-side track and the frame, the left-side and right-side track widening actuators configured to extend and retract the left-side track and the right-side track relative to the frame between a narrowed-stance and a widened-stance, wherein the left-side track and the right-side track are spaced further apart when in the widened-stance relative to the narrowed-stance.

3. The self-propelled emergency stretcher of claim 1, wherein the power plant comprises a battery, a left-side electric track drive motor in electrical communication with the battery, and a right-side electric track drive motor in electrical communication with the battery, the left-side and right-side electric track drive motors powering the left-side track and the right-side track, respectively.

4. The self-propelled emergency stretcher of claim 1, wherein the head-end caster wheel assembly lift actuator and the foot-end caster wheel assembly lift actuator are linear hydraulic actuators, and further comprising a hydraulic power unit mounted to the frame and in operative communication with each of the head-end caster wheel assembly lift actuator and the foot-end caster wheel assembly lift actuator.

5. The self-propelled emergency stretcher of claim 1, comprising a lift actuator disposed between the patient litter and the frame for controllably lowering and raising the patient litter relative to the frame.

6. A self-propelled emergency stretcher, comprising:

an elongate frame;

a set of wheels including first wheels disposed at a front end of the frame and second wheels disposed at a rear end of the frame;

a track drive unit mounted to the frame between the first wheels and the second wheels and comprising a left-side track disposed outwardly of a left-side of the frame and a right-side track disposed outwardly of a right-side of the frame;

a power plant mounted to the frame, the power plant configured to power the left-side track and the right-side track independently of one another; and a plurality of actuators for raising and lowering the first wheels and the second wheels relative to the frame;

wherein the plurality of actuators is configured to selectively switch the emergency stretcher between a self-propelled configuration in which the first wheels and the second wheels are out of contact with a ground surface below the emergency stretcher and the track drive unit is in contact with the ground surface and a manually-propelled configuration in which the first wheels and the second wheels are in contact with the ground surface and the track drive unit is out of contact with the ground surface.

7. The self-propelled emergency stretcher of claim 6, wherein the plurality of actuators comprises at least a first actuator disposed between the first wheels and the front end of the frame and at least a second actuator disposed between the second wheels and the rear end of the frame.

8. The self-propelled emergency stretcher of claim 7, wherein the at least a first actuator and the at least a second actuator are linear hydraulic actuators, and further comprising a hydraulic power unit mounted to the frame and in operative communication with each of the at least a first actuator and the at least a second actuator.

9. The self-propelled emergency stretcher of claim 6, further comprising a patient litter disposed above the frame and at least an actuator disposed between the patient litter and the frame, wherein the at least an actuator is configured to controllably lower and raise the patient litter relative to the frame.

10. The self-propelled emergency stretcher of claim 6, wherein the power plant comprises a battery, a left-side electric track drive motor in electrical communication with the battery, and a right-side electric track drive motor in electrical communication with the battery, the left-side and right-side electric track drive motors powering the left-side track and the right-side track, respectively.

11. The self-propelled emergency stretcher of claim 6, comprising a left-side track widening actuator disposed between the left-side track and the frame and a right-side track widening actuator disposed between the right-side track and the frame, the left-side and right-side track widening actuators configured to extend and retract the left-side track and the right-side track relative to the frame between a narrowed-stance and a widened-stance, wherein the left-side track and the right-side track are spaced further apart when in the widened-stance relative to the narrowed-stance.

12. A method for transporting a patient using a self-propelled emergency stretcher having a pair of tracks and a set of wheels, the method comprising:

transporting the patient over a first terrain in a self-propelled mode of operation in which the tracks engage a ground surface of the first terrain and are powered by an on-board power plant of the emergency stretcher;

lowering the set of wheels into contact with the ground surface and concomitantly raising the pair of tracks out of contact with the ground surface;

subsequent to raising the pair of tracks out of contact with the ground surface, operating at least an actuator disposed between the pair of tracks and the frame to adjust a lateral spacing between a first track of the pair tracks of the disposed outwardly of a left-side of the frame and a second track of the pair of tracks disposed outwardly of a right-side of the frame; and transporting the patient over a second terrain in a manually propelled mode of operation in which the set of wheels engage a ground surface of the second terrain.

13. The method of claim 12, wherein the ground surface of the second terrain is at least one of smoother, harder packed and more even compared to the ground surface of the first terrain.

14. The method of claim 12, wherein transporting the patient over a first terrain in a self-propelled mode comprises controlling the emergency stretcher via a wireless remote-control unit.

15. The method of claim 12, wherein transporting the patient over a first terrain in a self-propelled mode comprises controlling the emergency stretcher via an on-board control unit.

16. The method of claim 12, wherein lowering the set of wheels comprises operating at least an actuator disposed between the set of wheels and a frame of the emergency stretcher until the set of wheels engages the ground surface and continuing to operate the at least an actuator until the pair of racks is raised to a predetermined height above the ground surface.

* * * * *